US005398482A

United States Patent [19]

Hessell, Jr. et al.

[11] Patent Number: 5,398,482

[45] Date of Patent: Mar. 21, 1995

[54] SEAT SKINNING APPARATUS AND METHOD

[75] Inventors: Joseph M Hessell, Jr., Utica; Robert P. Adams, Mt. Clemens; Donald J. Hotton, Rochester Hills; William J. Wildern, IV, Farmington Hills; Bradley A. Johnston, Clinton Township, Macomb County, all of Mich.

[73] Assignee: General Motors Corporation, Detriot, Mich.

[21] Appl. No.: 28,861

[22] Filed: Mar. 10, 1993

[51] Int. Cl.[6] ..... B65B 1/24; B68G 7/06

[52] U.S. Cl. ..... 53/436; 53/459; 53/526; 53/527; 29/91.1; 29/91.5

[58] Field of Search ..... 29/91, 91.1, 91.5, 91.7; 53/436, 459, 469, 524, 526, 527, 529, 570, 255, 284.7

[56] References Cited

U.S. PATENT DOCUMENTS

| | | | |
|---|---|---|---|
| 568,648 | 9/1896 | White . | |
| 1,893,610 | 1/1933 | Belcher | 53/526 |
| 2,693,304 | 11/1954 | Davis et al. . | |
| 2,749,690 | 6/1956 | Bridges et al. . | |
| 2,907,156 | 10/1959 | Anderson . | |
| 3,161,003 | 12/1964 | Grintz . | |
| 3,252,737 | 5/1966 | Seaton | 29/91.1 X |
| 3,270,485 | 9/1966 | Knepper . | |
| 3,660,964 | 5/1972 | Willis et al. . | |
| 3,669,498 | 6/1972 | Meyers et al. . | |
| 4,300,327 | 11/1981 | Bridger . | |
| 4,385,427 | 5/1983 | Fraiser . | |
| 4,557,522 | 12/1985 | Isikawa . | |
| 4,665,606 | 5/1987 | Saito et al. . | |
| 4,675,962 | 6/1987 | Tillner et al. | 29/91.1 |
| 4,679,379 | 7/1987 | Cassoli . | |
| 4,711,067 | 12/1987 | Magni . | |
| 4,813,740 | 3/1989 | Yon et al. . | |
| 4,837,905 | 6/1989 | Sullivan et al. | 29/91.5 |
| 4,845,925 | 7/1989 | Thompson . | |
| 4,860,415 | 8/1989 | Witzke . | |
| 4,986,055 | 1/1991 | Mintz et al. | 53/526 |

FOREIGN PATENT DOCUMENTS

| | | | |
|---|---|---|---|
| 1948472 | 4/1971 | Germany | 53/524 |

*Primary Examiner*—Daniel C. Crane
*Attorney, Agent, or Firm*—Ernest E. Helms

[57] ABSTRACT

A mechanism for skinning a membrane cover onto a polymeric foam vehicle seat body is provided which, in a preferred embodiment, includes a frame which can releasably hold front and rear ends of the cover in a generally horizontal orientation with an apex of the cover extending vertically downward, providing an opening in the cover for insertion of the seat body, a first reaction member moved by a first cylinder in a generally horizontal direction for compressing the seat cover and the seat body in a generally horizontal direction, and a bottom plate with side arms, the side arms having sheeting strip support surfaces, the bottom plate also having operatively associated sheeting strips having a first fixed end connected with the frame and a second free end placed over the sheeting strip support surface and into the cover before insertion of the seat body into the cover, and the bottom plate and side arms being connected with a pop-up cylinder for extending the seat body upward from the mechanism after insertion of the seat body into the cover, allowing the sheeting strips to be pulled out of the cover.

12 Claims, 4 Drawing Sheets

SEAT SKINNING APPARATUS AND METHOD

FIELD OF THE INVENTION

The field of the present invention is that of apparatuses and methods of utilization thereof of vehicle seat skinners. More particularly, the present invention refers to seat skinners which put on a membrane cover such as leather, vinyl or plastic on a polymeric foam vehicle seat body.

DISCLOSURE STATEMENT

Many vehicle seat backs, especially bucket-type seats, have a metal frame member which is covered with a polymeric foam. Covering the polymeric foam in a pillow-type fashion is a membrane such as leather, vinyl or fabric. The volume of the membrane cover is smaller than the volume of the polymeric foam in a free state to insure a seat with the best appearance. Therefore, to place the cover on the foam body there must be some means to compress the foam. The primary method of accomplishing the above is a mechanism which has two plates, commonly referred to as a clamshell. The foam body is captured between the plates. One of the plates is movable by a piston. Once the clamshell has closed upon the foam body, the cover is put over the clamshell, and a pop-up cylinder pushes the foam body from the clamshell, causing the foam body to be located within the cover.

There are several reasons why the clamshell is undesirable. The first reason is that even when compressed, pulling the cover down over the foam body is a strenuous operation and has been found to be taxing to workers. In instances where a headrest is being utilized, the worker must be very careful to align the headrest post holes in the cover with the headrest post holes in the foam body. The above is a matter of an and takes a skilled operator to accomplish. If the foam body is misaligned, the cover must be pulled off, which again is a very strenuous operation. Thirdly, due to the frictional characteristics of polymeric foam, especially with fabric covers, it is necessary to put in a lining over the foam, which is typically called angel hair, to keep the cover from sticking to the foam during its installation (even when the foam is being compressed). The above-mentioned fabric covering typically referred to as angel hair provides a negative impact to the cost of the seat and can interfere with Velcro-type connection strips, which give added means of attachment of the cover to the foam body.

SUMMARY OF THE INVENTION

To overcome the above-noted problems, the present invention is brought forth. The present invention provides an apparatus and method of utilization of a vehicle seat skinning device which holds the cover, allows the foam body to be pushed downward into the cover, and eliminates the need for any angel hair in assisting installation of the foam body into the cover. These and other advantages of the present invention will be more apparent to those skilled in the art as the present invention is further explained in the accompanying drawings and detailed description.

DESCRIPTION OF THE PREFERRED EMBODIMENTS

Figure 1:
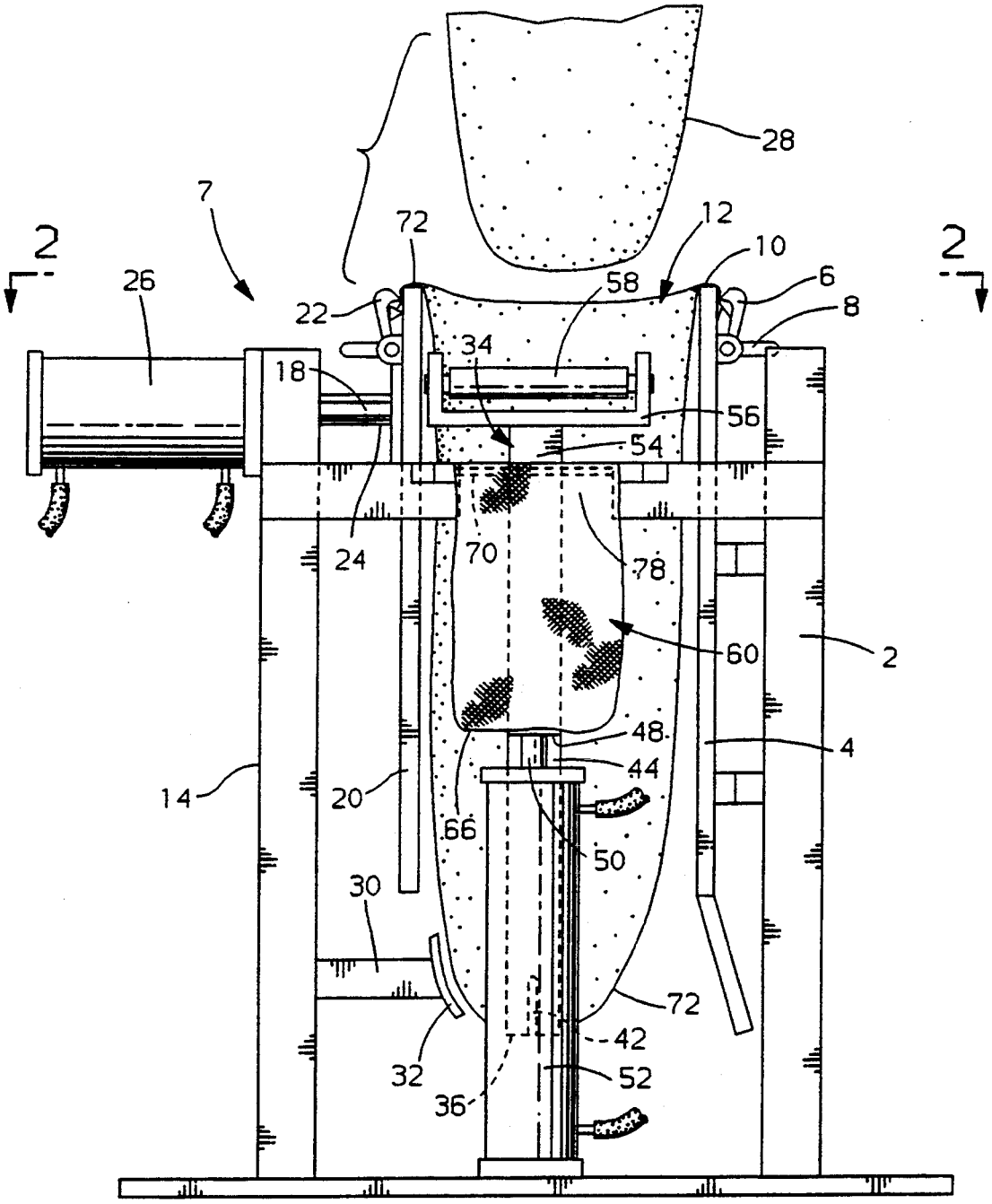
FIG. 1 is a side elevational view of a preferred embodiment seat skinning mechanism according to the present invention.
Figure 2:
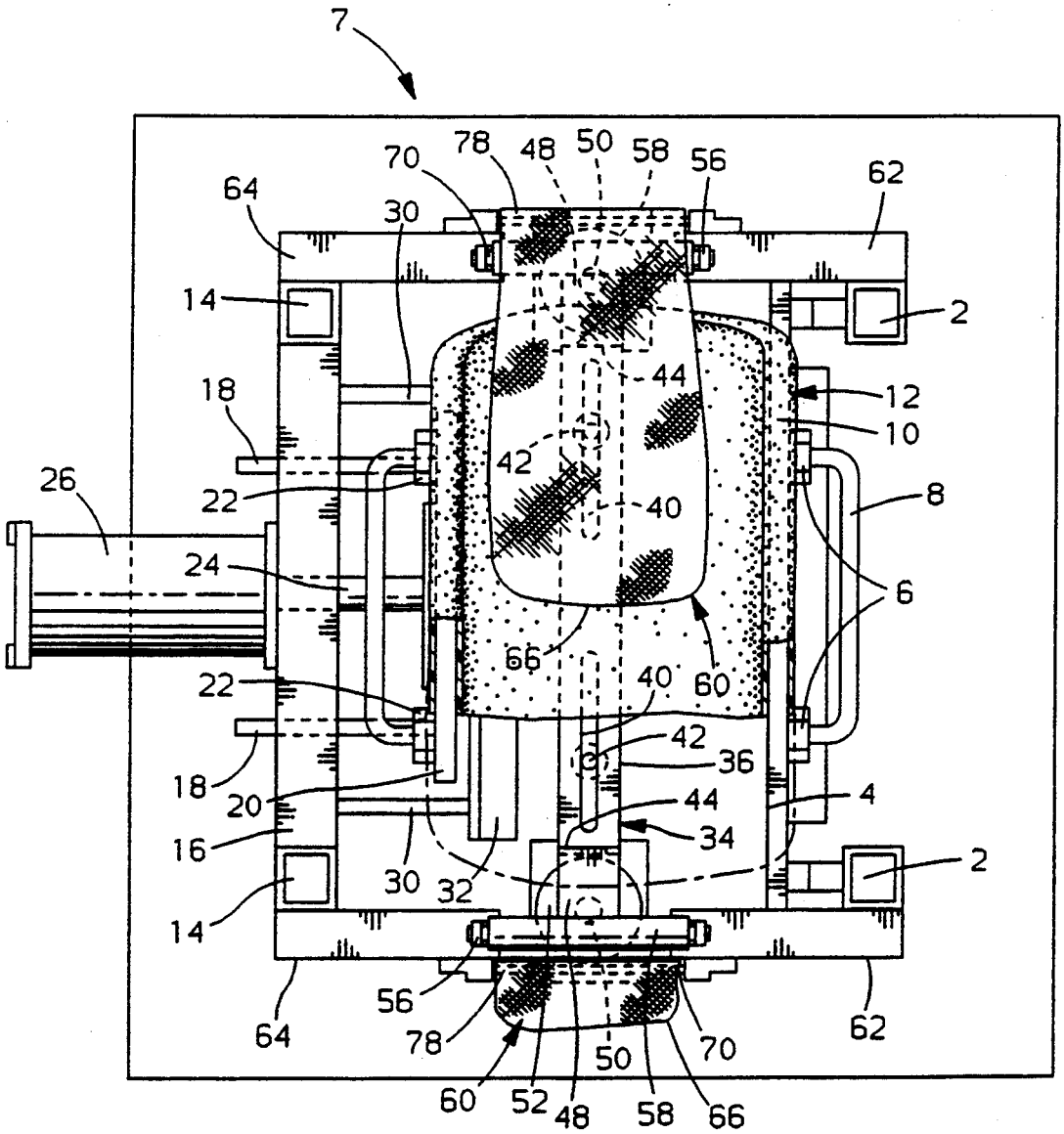
FIG. 2 is a view taken along line 2—2 of FIG. 1.
Figure 3:
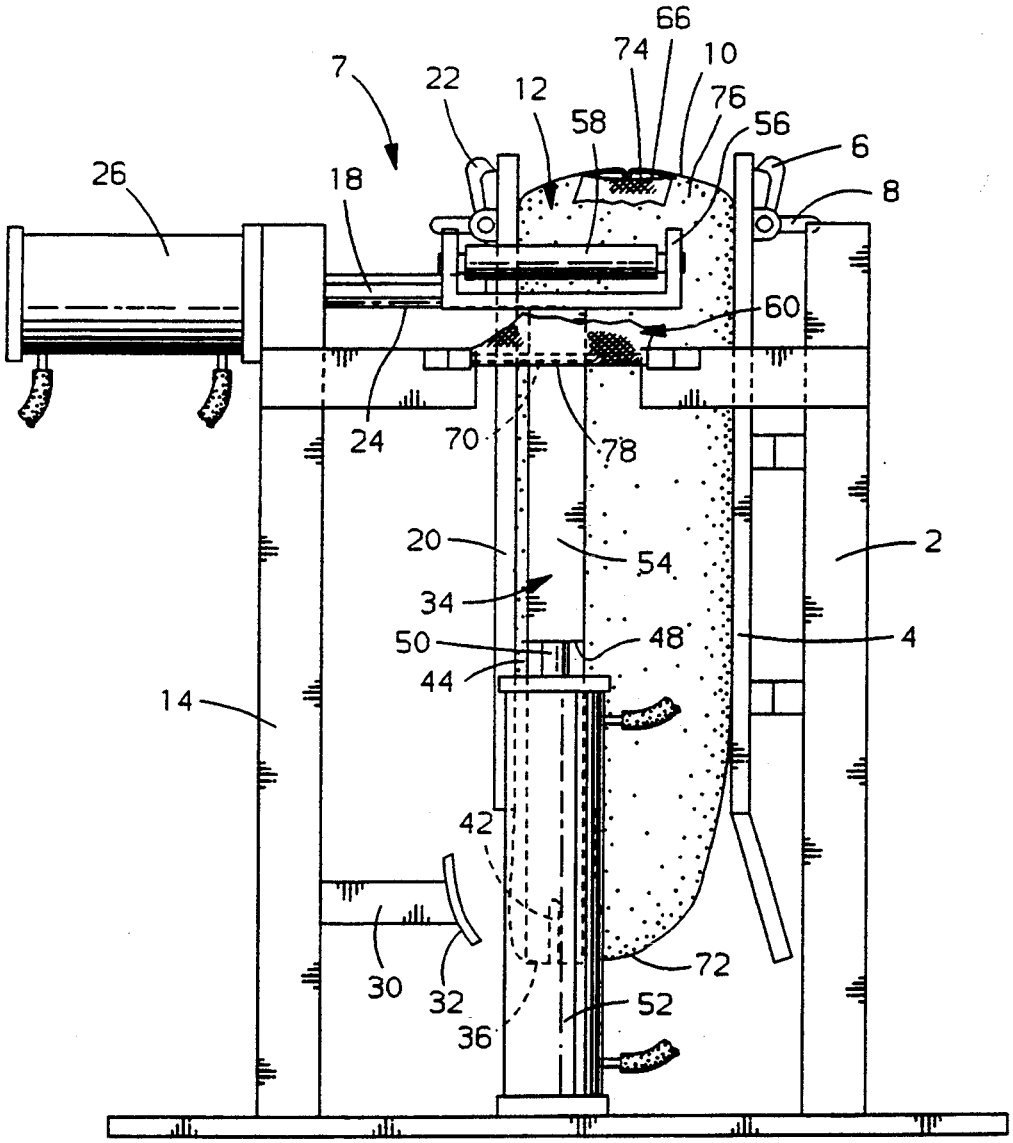
FIG. 3 is a view similar to FIG. 1 showing the compressive stage of operation of the present invention.

Referring to FIGS. 1 through 4, a seat skinning mechanism 7 has a frame with two front posts 2. Joined to the front post 2 is a front plate 4. Connected at the top end of the front plate at approximately waist level or height is a spring biased clip 6 having a handle 8 which releasably holds a front end portion of a cover 12 in a generally horizontally fixed orientation. This front end usually has what is referred to in the industry as the J strip.

A rear stand has two frame post members 14 joined by a rear cross member 16. The rear cross member 16 slidably supports two pin guides 18. The pin guides 18 are connected with a first reaction member or rear plate 20. At the top end of the rear plate 20 is a cover retaining clip 22 which, in a manner substantially the same as clip 6, holds a rear end portion of the cover 12 in a generally horizontally fixed orientation spaced from the front end of the cover 10, providing an opening in the cover. The rear plate 20 is also connected with a piston rod 24 which is powered by an air cylinder 26, which allows the rear plate 20 to be moved horizontally to compress the cover 12 after a polymeric foam seat body has been inserted therein.

Below the rear beam 16 is another beam (not shown) which has connected thereto arms 30 which support an alignment plate 32. The general function of the alignment plate 32 will be explained later. Between the front post 2 and the rear post 14 is a U-shaped bracket 34. The U-shaped bracket 34 has a bottom plate 36. The bottom plate 36 has two generally longitudinal slots 40 which allow for adjustable placement of headrest post alignment pins 42. Joined to the bottom plate 36 is a first upper extending plate 44 which, if desired, may be slightly tapered outward, providing lateral alignment for the predefined form vehicle seat foam body 28. Above the first upward member 44 is a short horizontal piece 48 which provides an attachment surface for rods 50 of pop-up cylinders 52. Also joined to horizontal member 48 are stand support members 54 which extend vertically upward. The stand support members 54 have a bracket 56 which rotatively supports a roller 58. The roller 58 provides a support surface for sheeting strips 60. The sheeting strips 60 have one end 78 fixably connected to side beams 62 and 64 via a pivotal attachment rod 70 which extends between the two side beams. The free end 66 of the sheeting strips are laid within the cover 12.

Referring to FIG. 1, in operation the cylinders 26 and 52 will both be in their retracted position. The front end 10 of the seat cover 12 and the rear end 72 of the seat cover 12 will be placed in position by their respective clips 6 and 22. The bottom portion or the apex of the cover 12 will be aligned by pins 42 with apertures in the cover provided for insertion of a vehicle headrest post. The two sheeting strips 60 will be placed over the rollers 58 and then inserted downwardly into the cover 12. These strips are typically of a nylon material and therefore keep the cover from sticking to the foam body 28 upon its insertion. The operator (not shown) will stand at the front end of the skinning mechanism 7 and will insert the foam body 28 typically at a slight tilted angle down into the cover 12. The alignment plate 32 serves two functions. The first function is to keep the apex of the cover 12 from shifting too far rearwardly, and the second function is to act as target for the operator to keep the foam body 28 from going too far rearwardly. Additionally, the alignment pins 42 will provide alignment for the foam body 28, which also has matching holes (not shown) for the post of the headrest.

After the insertion of the foam body 28 into the cover, the cylinder 26 will be signaled to extend the piston rod 24, causing the rear plate 20 to move horizontally, compressing the foam body 28 within the cover 12. While still in compression, the machine operator will release the front and rear ends of the cover by pushing down on the appropriate hand levers and will then attach the covers to one another, typically called the J connectors. Herein lies one of the advantage of the present invention in that two things occur. The first thing that occurs upon compression of the rear plate 20 is that the Velcro connectors embedded in the foam body 28 are matched with the Velcro connectors placed in the seat cover 12 and the form of the seat is now provided. Additionally, since the foam body 28 is in compression, the close-out of the seat cover can be accomplished without performing a separate operation. Prior to the present invention, to achieve close-out of the cover, the seat body with its cover on it had to be taken to another mechanism to again compress it and close out the J-strap connections.

Figure 4:
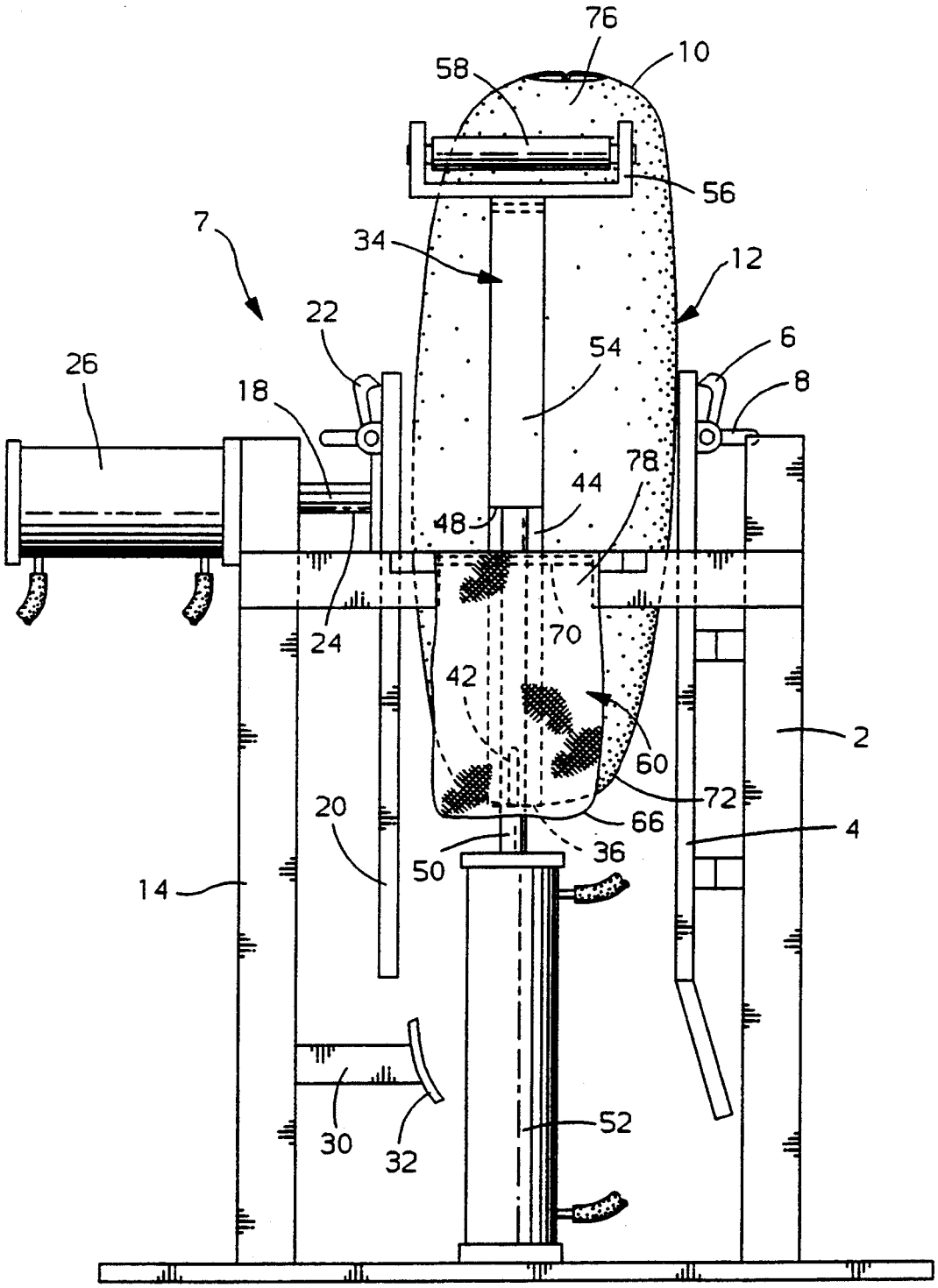
FIG. 4 is an illustration of a later stage of the operation of the seat skinning mechanism of the present invention.

With the J-strap connections closed, there is a slight opening of the cover noted as 74 with an end flap of the seat 76. The piston 26 is then signaled for the rear plate 20 to retract. Although cut away for clarity of illustration in FIG. 3, the sheeting strip 60 is still within the cover 12 and comes out of the cover 12 through the aperture 74. Referring additionally to FIG. 4, the pop-up pistons 52 are then signaled, and as the U-bracket 34 extends upwardly, the sheeting strip 60 is pushed upwardly by the roller 58, which is also moved upwardly by the pop-up pistons 52. The fixed end 78 of the angel hair strip is fixed to the rod 70 and therefore cannot move. Accordingly, the angel hair strips 60 are pulled out of the cover 12. Note: The sheeting strips 60 are confined to the sides of the foam body 28 and cover 12. Therefore, they will not interfere with the Velcro connections, which are on the front portion of the foam body 28.

While this invention has been described in terms of a preferred embodiment thereof, it will be appreciated that other forms could readily be adapted by one skilled in the an. Accordingly, the scope of this invention is to be considered limited only by the following claims.

The embodiments of the invention in which an exclusive property or privilege is claimed are defined as follows:

1. A mechanism for aiding an operator skinning a pillow-type membrane cover having an open end and an apex opposite the open end, the open end having a front portion and a rear portion, onto a predefined form polymeric foam vehicle seat body comprising:

a frame;

means to hold a front portion of the cover open end in a generally fixed horizontal orientation with an apex of the cover extending vertically downward, the front portion hold means being vertically fixed with respect to the frame;

means to hold a rear portion of the cover open end in a generally fixed horizontal orientation spaced from the front end portion of the cover;

means to compress the vehicle seat body after an operator insertion of the vehicle seat body into the cover, compressing the vehicle seat body in a generally horizontal direction, said compressing means being movable horizontally; and means to release the means to hold the front portion of the cover end and means to release the means to hold the rear portion of the cover end to allow the cover to be closed out by the operator while the vehicle seat body is still being compressed.

2. A mechanism as described in claim 1 further comprising flexible sheeting strips for insertion into the cover to reduce the friction between the vehicle seat body and the cover during operator insertion of the vehicle seat body.

3. An apparatus as described in claim 1 wherein the cover is held at generally a waist height of the mechanism operator.

4. A mechanism as described in claim 1 further comprising an alignment plate for generally aligning the insertion process of the vehicle seat body into the cover, the alignment plate being horizontally underneath the means to hold the ends of the cover.

5. A mechanism as described in claim 1 further including transverse alignment plates Opposing one another extending generally vertically for aligning and confining the vehicle seat body within the cover.

6. A mechanism as described in claim 1 further including a headrest alignment pin located generally adjacent the apex of the cover, allowing a headrest hole in the cover and in the vehicle seat body to be aligned with one another.

7. A mechanism as described in claim 1 further including a pop-up cylinder to eject the vehicle seat body from the mechanism after the vehicle seat body has been skinned.

8. A mechanism as described in claim 7 further including a sheeting strip support surface and flexible sheeting strips, the sheeting strips having one end locationally fixed with respect to the frame and a second end for extending over the sheeting strip support surface and placed within the cover before insertion of the vehicle seat body into the cover, the sheeting strip support surface being moved upwardly by the pop-up cylinder so that upward extension of the support surface causes the sheeting strips to be upwardly pulled out of the cover upon upward operation of the pop-up cylinder.

9. A mechanism for aiding an operator to skin a pillow-type membrane cover having an open end and an apex opposite the open end, the open end having a front portion and a rear portion, onto a polymeric foam vehicle seat body comprising:

a frame;

means to releasably hold a front portion of the end of the cover in a generally horizontal orientation with an apex of the cover extending vertically downward;

means to releasably hold a rear portion of the end of the cover in a generally horizontal orientation spaced from the front portion of the cover end providing an opening in the cover;

a first reaction member moved by a first cylinder in a generally horizontal direction for compressing the seat cover and the vehicle seat body in a generally horizontal direction; and a bottom plate with side arms, the side arms having sheeting strip support surfaces, the bottom plate also having operatively associated flexible strips having a first fixed end connected with the frame and a second free end placed over the sheeting strip support surface and into the cover before an operator insertion of the vehicle seat body into the cover, and the bottom plate and side arms being connected with a pop-up cylinder for extending the vehicle seat body upward from the mechanism after the operator insertion of the seat body into the cover, allowing the sheeting strips to be pulled out of the cover.

10. A method for skinning a membrane pillow-type cover with an open end with front and rear portions and an apex opposite the open end onto a predefined form polymeric foam vehicle seat body comprising:

holding the front end portion of the cover in a generally horizontal fixed orientation with an apex of the cover extending vertically downward;

holding the rear end portion of the cover in a generally horizontal fixed orientation spaced from the front end portion providing an opening in the cover;

inserting the vehicle seat body into the cover in a generally downward direction; and compressing the vehicle seat body within the cover in a generally horizontal direction, by reducing the thickness of the vehicle seat body after said vehicle seat body is inserted into said cover while the front end portion and the rear end portion of the cover are held in a horizontally fixed position, than allowing the cover to be closed upon the vehicle seat body after releasing the front and rear portion of the cover.

11. A method as described in claim 10 further including aligning the cover with headrest pins which insert through headrest pole holes provided in the cover and aligning the headrest holes within the vehicle seat body with the headrest pins upon insertion into the cover.

12. A method as described in claim 10 further including, before insertion of the vehicle seat body into the cover, attaching a fixed end of flexible sheeting strips to the mechanism and at another end extending the sheeting strips on a sheeting strip support surface, the sheeting strip then extending generally vertically downward into the cover, connecting the sheeting strip support surface with a pop-up cylinder, extending the pop-up cylinder after the vehicle seat body has been compressed and the cover has been closed, and thereby removing the skinned vehicle seat body from the mechanism while at the same time pulling the sheeting strips out of the cover through apertures provided in the cover.

* * * * *